US009504097B2

(12) United States Patent
Fowler et al.

(10) Patent No.: US 9,504,097 B2
(45) Date of Patent: Nov. 22, 2016

(54) FULL SUPPORT HEATING ELEMENT APPARATUS

(71) Applicant: Backer EHP Inc., Murfreesboro, TN (US)

(72) Inventors: Lucas Lee Fowler, Murfreesboro, TN (US); Donald Edmond Porterfield, Lascassas, TN (US); Rickey James Schexnayder, Readyville, TN (US)

(73) Assignee: BACKER EHP INC., Murfreesboro, TN (US)

( * ) Notice: Subject to any disclaimer, the term of this patent is extended or adjusted under 35 U.S.C. 154(b) by 617 days.

(21) Appl. No.: 13/769,016

(22) Filed: Feb. 15, 2013

(65) Prior Publication Data

US 2014/0231412 A1 Aug. 21, 2014

(51) Int. Cl.
*H05B 3/10* (2006.01)
*H05B 3/16* (2006.01)

(52) U.S. Cl.
CPC ..... *H05B 3/16* (2013.01)

(58) Field of Classification Search
CPC .. F24H 9/1818; F24H 9/1854; F24H 9/1863; F24H 9/2064; F24H 9/2071; H05B 3/32; H05B 3/22; H05B 3/26; H05B 3/262; H05B 3/265; H05B 3/267; H05B 3/20
See application file for complete search history.

(56) References Cited

U.S. PATENT DOCUMENTS

| | | | | |
|---|---|---|---|---|
| 3,805,020 | A | 4/1974 | Bates | |
| 4,163,146 | A * | 7/1979 | Meywald | H05B 3/16 219/532 |
| 5,124,534 | A | 6/1992 | Williams et al. | |
| 5,324,919 | A * | 6/1994 | Howard | F24H 3/0405 206/320 |
| 5,578,232 | A * | 11/1996 | Engelke | H05B 3/32 219/532 |
| 5,925,273 | A | 7/1999 | Sherrill | |
| 6,215,108 | B1 | 4/2001 | Butcher et al. | |
| 2004/0178189 | A1 * | 9/2004 | Peyronny | F24H 7/002 219/530 |
| 2010/0237059 | A1 * | 9/2010 | Porterfield | H05B 3/16 219/482 |

OTHER PUBLICATIONS

"Heating Alloys for Electric Household Appliances", Kanthal Appliance Alloys Handbook,Kanthal AB, Hallstahammar, Sweden, 99 pages.

* cited by examiner

*Primary Examiner* — Shawntina Fuqua
(74) *Attorney, Agent, or Firm* — Neal, Gerber & Eisenberg LLP

(57) ABSTRACT

An electric heater apparatus for heating air is disclosed, comprising a heater coil assembly including a coil support comprising a panel around which lies a coil of an electrical resistance element from approximately one end of the panel to approximately an opposite end, the coil of the electrical resistance element comprising a pass of spaced apart loops, the coil support configured to support the spaced apart loops.

33 Claims, 9 Drawing Sheets

FULL SUPPORT HEATING ELEMENT APPARATUS

BACKGROUND

This application relates generally to electric heater units for air handlers, and more specifically to apparatuses and methods for reducing the overall size of electric heater units and to reduce their cost to manufacture.

Conventional electric heaters for heating air in air handlers for residential and commercial heating ventilation and air conditioning ("HVAC") systems, electric heat laundry dryers, in-line duct heaters, air curtains, blow dryers, hand dryers, toasters, kitchen appliances and the like typically include one or more electrical resistance wires, often formed in the shape of a coil. Such coils are typically supported by ceramic insulators at discrete, space-apart intervals. To minimize span-wise coil deflection or deformation that may occur due to the heat generated when the wires are electrically energized from electrical current flowing therethrough, the resistance wires may be formed from nickel chromium alloys, which are relatively durable materials known to be resistant to heat and deflection over many thermal cycles and which assist in retaining the shape of the coil. However, nickel and chromium are both susceptible to market price fluctuations, and their inclusion in the composition of the resistance wire may increase the overall cost of each electric heater unit. Moreover, the width of electric heaters cannot easily be reduced because the size of a given electric heater is dictated, in part, by the desired heat output, which is a function of the length, material, diameter (e.g., the wire gauge), and geometry of the coiled wire of the resistive heating element.

SUMMARY

An electric heater apparatus for heating air is disclosed, comprising a heater coil assembly including a coil support comprising a panel around which lies a coil of an electrical resistance element from approximately one end of the panel to approximately an opposite end, the coil of the electrical resistance element comprising a pass of spaced apart loops, the coil support configured to support the spaced apart loops.

The spaced apart loops may include an elliptical shape. A portion of the pass of spaced apart loops may extend past a longitudinal edge of the coil support. The coil support may lie along a longitudinal axis of the coil of the electrical resistance element. The coil support may comprise mica. The coil support may comprise a heat resistant material, which may withstand an operating temperature of at least approximately 1700° F. The coil support may comprise a high dielectric constant.

The electric heater apparatus may include a pair of heater coil assemblies arranged side-by-side, where a single length of the electrical resistance element may form the coils associated with the pair heater coil assemblies. The electric heater apparatus may include a first plurality of pairs of heater coil assemblies and a second plurality of pairs of heater coil assemblies arranged offset and in staggered relation to the first plurality of pairs of heater coil assemblies.

The electrical resistance element may comprise resistance wire, which may be 16 gauge or smaller. The electrical resistance element may comprise a low-nickel composition, which may be approximately 40% nickel or less. The electrical resistance element may comprise a composition excluding nickel altogether. The electrical resistance element may comprise a ribbon.

In another embodiment, an electric heater apparatus for an air handler is disclosed, comprising a base plate, a plurality of frame supports extending from the base plate, a plurality of cross supports connected to the frame supports, and at least one heating element assembly connected to the cross supports. The at least one heating element assembly comprises a coil of resistance wire comprising a plurality of spaced apart elliptical portions arranged with respective vertices of the elliptical portions substantially aligned with one another, and at least one coil support for supporting the coil of resistance wire. The coil support comprises a panel positioned inside the coil of resistance wire and at the respective vertices of the elliptical portions. The at least one coil support supports the plurality of elliptical portions of the coil of resistance wire.

The at least one coil support may comprise mica. The electric heater apparatus may comprise a first plurality of heating element assemblies and a second plurality of heating element assemblies arranged offset and in staggered relation to the first plurality of heating element assemblies.

The resistance wire may comprise approximately 16 gauge or smaller. The resistance wire may comprise a low-nickel composition, such as approximately 40% nickel or less. The resistance wire may alternatively comprise a composition excluding nickel altogether.

The at least one coil support may be positioned at an oblique angle relative to the direction of airflow through the air handler during operation. A side of the least one coil support may be engaged with a slot in the cross supports.

In another embodiment, an electric heater apparatus for an air handler is disclosed, comprising a base plate, a plurality of frame supports extending from the base plate, a plurality of cross supports connected to the frame supports for supporting the cross supports, and at least two heating element assemblies connected to the cross supports on opposite sides of the cross supports in staggered relation to one another. The cross supports support the at least two heating element assemblies. Each of the at least two heating element assemblies comprise a plurality of spaced apart coils of resistance wire arranged side-by-side where at least one of the coils comprise a plurality of spaced apart elliptical portions arranged with respective vertices of the elliptical portions substantially aligned with one another, and at least one coil support comprising at least one panel positioned inside each of the spaced apart coils and supporting a majority of turns of each of the spaced apart coils at each of approximately two locations of each such turn approximately opposite one another.

A side of the at least one coil support may be engaged with a slot in the cross supports. The at least one coil support and the cross supports may be captively yet releasably coupled to one another opposite the slot without fasteners. The cross supports may comprise a protrusion that engages an aperture in the at least one coil support. The cross supports and the at least one coil support may be held together via a snap fit. The at least one coil support may comprise mica. The resistance wire may comprise a composition of approximately 40% nickel or less. The resistance wire may comprise a composition that does not include any nickel. Adjacent spaced apart coils may be electrically connected to one another in parallel by the resistance wire.

In another embodiment, an electric heater apparatus for heating air is disclosed, comprising a plug-in module including a plurality of spaced apart heater coil assemblies arranged side-by-side and connected in parallel to one another. Each of the heater coil assemblies comprise a coil support including a panel around which lies a coil of resistance wire. The coil of resistance wire comprises a pass of forward loops and a pass of rearward loops alternating therebetween. The resistance wire starts and ends at approximately one end of the coil support. The coil support is configured to support each of the forward loops and rearward loops.

The coil support may be configured to support each loop of the coil at each of two points per loop. The forward loops and rearward loops may comprise an elliptical shape. The panel may be heat and deflection resistant. The panel may comprise mica. A pair of terminal posts may be positioned near an end of the module for parallel connection of the resistance wire associated with each heater coil assembly.

The resistance wire may comprise 18 gauge or smaller. The resistance wire may comprise a low-nickel composition. The resistance wire may comprise a composition that excludes nickel.

In another embodiment, an electric heating element assembly for heating air is disclosed, comprising a coil support, a jumper, and a jumper mount. The coil support includes a panel around which lies a coil of resistance wire. The coil of resistance wire comprises a pass of loops. The resistance wire starts at approximately a first end of the coil support and ends at approximately an opposite, second end of the coil support. The coil support is configured to support the pass of loops. The jumper is positioned proximate to the panel and is configured to return electrical continuity from the first end to the second end and vice-versa. The jumper mount is positioned proximate to the jumper to electrically insulate the jumper from the coil. The jumper and the jumper mount are positioned between the pass of loops and the coil support.

The coil support may be configured to support the loops of the coil at each of two points per loop. The forward loops and the rearward loops may comprise an ellipse. The panel may be heat and deflection resistant, and may comprise mica.

A pair of terminal posts may be positioned near an end of the module for parallel connection of the resistance wire associated with each heating element assembly. The resistance wire may comprise, for example, 18 gauge or smaller. The resistance wire may comprise a low-nickel composition. The composition may comprise approximately 40% or less nickel. The resistance wire may comprise a composition that excludes nickel altogether.

DETAILED DESCRIPTION

Figure 1:
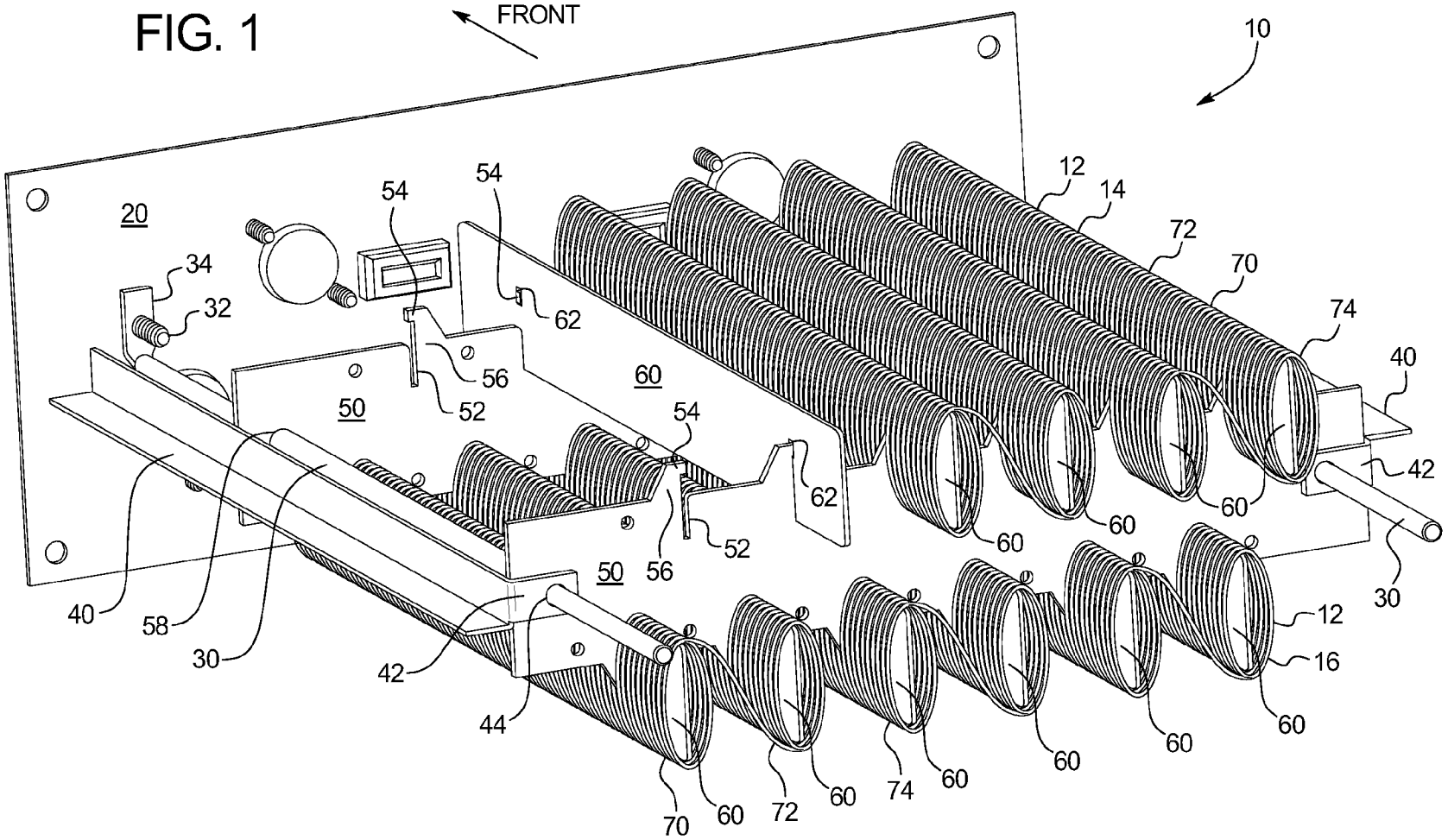
FIG. 1 is a partial perspective view of one embodiment of an electric heater apparatus.

Turning now to the figures, wherein like reference numerals refer to like elements, there is shown one or more embodiments and aspects of an electric heater assembly to provide electric heat for residential and commercial HVAC applications. Although the figures and the instant disclosure describe one or more embodiments and aspects of an electric heater assembly for HVAC applications, one of ordinary skill in the art would appreciate that the teachings of the instant disclosure would not be limited to these embodiments. In particular, the instant disclosure may be applicable to any number of fields or applications involving a heat exchange with a working fluid, such as air, upon exposure of the working fluid to an electrically resistive heating element, including electric heat laundry dryers, in-line duct heaters, air curtains, blow dryers, hand dryers, toasters, kitchen appliances, and the like.

Turning to the embodiment shown in FIG. 1, there is shown an exemplary 12-pass (two passes associated with a coil-pair are not shown for clarity) electric heater assembly 10 comprising two rows of six coil-pairs ("dual coils") each. Electric heater assembly 10 may be installed in a residential or commercial HVAC air handler either horizontally, vertically, or at an angle depending on the direction of flow of the working fluid. A resistive heating element portion of electric heater assembly 10 is configured to be in direct contact with a fluid, such as air. Heat exchange between the resistive heating element portion and the fluid is accomplished by passing an electrical current through the resistive heating element while the fluid is passed by the resistive heating portion.

In the embodiment of FIG. 1, electric heater assembly 10 is shown as including base plate 20, a plurality of frame supports 30, a plurality of cross supports 50, a plurality of slide members 40, and a plurality of heating element assemblies 12 comprising heater coil assemblies 70. Each heater coil assembly 70 includes coil support 60 and a length of electrical resistance element 72 of a suitable geometry helically wound around coil support 60 along the length of each coil support 60, the combination of length, geometry, and material composition of resistance element 72 providing a desired heat output. Resistance element 72 may comprise resistance wire, which may be any size or gauge suitable for generating a desired amount of heat to the working fluid. For example, resistance element 72 may comprise resistance wire of approximately 14 gauge or smaller, including resistance wire as small as approximately 24 gauge or smaller, depending on the needs of a particular application. In some embodiments of electric heater assembly 10, resistance element 72 comprises a resistance ribbon. Although the embodiment of FIG. 1 shows two rows of heater coil assemblies 70, each row comprising three pairs of heater coil assemblies 70, in other embodiments, a fewer or greater total number of heater coil assemblies 70 may be utilized to obtain a desired heat output.

As shown in the embodiment of FIG. 1, electric heater assembly 10 comprises two heating element assemblies 12—an upper heating element assembly 14 and a lower heating element assembly 16 positioned in staggered relation and below upper heating element assembly 14. Upper heating element assembly 14 and lower heating element assembly 16 may individually comprise any number of heating coil assemblies 70 or groups of heating coil assemblies 70. As compared to co-aligned heater coils 70 one above the other in the fluid flow stream, staggered heater coil assemblies 70 improves convective heat transfer from heater coil assemblies 70 to the working fluid through better exposure of each heater coil assembly 70 to the working fluid. In other embodiments, a fewer or greater number of heating element assemblies 12 may be included to obtain a desired heat output. Likewise, heating element assembly 12 may include a fewer or greater number of upper heating element assemblies 14 and/or lower heating element assemblies 16 to obtain a desired heat output. Although electric heater assembly 10 is shown in FIG. 1 as permitting air to flow therethrough either up or down in the vertical direction, electric heater assembly 10 may be oriented at any angle in a HVAC air handler depending on the direction, temperature and amount of airflow, the desired heat output, and other design considerations. Coil supports 60 may be oriented substantially parallel or at any oblique angle or combination thereof relative to the intended direction of airflow through electric heater assembly 10.

Upper heating element assembly 14 and lower heating element assembly 16 may be wired in parallel to one another. A plurality of upper heating element assemblies 14 may be wired in parallel with one another. Likewise, a plurality of lower heating element assemblies 16 may be wired in parallel with one another. In the embodiment of FIG. 1, upper heating element assembly 14 and lower heating element assembly 16 each comprise six heater coil assemblies 70 arranged in pairs, each pair electrically connected together (two heater coil assemblies 70 are not shown in upper heating element assembly 14 for purposes of clarity), each heater coil assembly 70 comprising coil support 60 and resistance element 72 wound thereon over the length of each coil support 60. A single length of resistance element 72 may be used for each pair of heater coil assemblies 70. One of ordinary skill would appreciate, however, that heating element assembly 12 may comprise any number of heater coil assemblies 70 as desired to obtain a target heat output.

Base plate 20 may comprise a panel made of, for example, a metal of suitable thickness and other properties from which to mount and support the other elements of electric heater assembly 10. Each frame support 30 may comprise bracket 34 for connecting to base plate 20 by screw 32. Frame supports 30 may alternatively be connected to base plate 20 using any other means, including by welding or by weldless interlocking of adjacent parts. In the embodiment shown in FIG. 1, frame supports 30 are formed in the shape of cylindrical rods cantileverly connected to and perpendicularly extending rearwardly from base plate 20 and connected to base plate 20 using brackets 34 and screws 32. Frame supports 30 may alternatively comprise any cross sectional shape.

Slide members 40 may include bracket 42 comprising aperture 44 for receiving and securing frame supports 30. On the opposite end, slide member 40 may be secured to base plate 20 via, for example, a mating slot in base plate 20 configured to interlock slide member 40 with base plate 20. In the embodiment shown in FIG. 1, slide members 40 are cantileverly connected to and perpendicularly extending rearwardly from base plate 20.

As shown in the embodiment of FIG. 1, cross supports 50 each comprise a panel of suitable thickness on which is mounted coil supports 60. Cross supports 50 may be made from an electrically insulative material, and may have a suitable geometry, strength, durability, and resistance to heat for the intended application. In one embodiment, cross supports 50 comprise mica. Cross supports 50 of FIG. 1 each include slots 52 for receiving coil supports 60, and extension members 56 and male members 54 for securing coil supports 60 to cross supports 50. Cross supports 50 may be received and supported by frame supports 30 through apertures 58 in cross supports 50. Frame supports 60 may, in turn, be supported by slide member 40 anchored to base plate 20. As shown in the embodiment of FIG. 1, a pair of cross supports 50 may be positioned perpendicularly to frame supports 30 and/or slide members 40 and opposite one another at locations along frame supports 30 that are suitable for supporting coil supports 60 of heating element assemblies 12.

Apertures 58, slots 52, extension members 56, male members 54, and any other feature of cross supports 50 may be repeated in predefined patterns on cross support 50 for ease of manufacturing, part interchangeability, and stocking of parts. Coil supports 60 may comprise pre-fabricated areas of weakness, such as score lines, to enable an assembler, for example, to break off undesired portions of coil supports 60 to configure coil supports 60 for a desired length to accommodate a desired depth for electric heater assembly 10.

Coil supports 60 may comprise a panel. Although shown as relatively thin panels in the figures, each coil support 60 may comprise any suitable thickness. As shown in FIG. 1, the thickness of the panel of each coil support 60 may be configured to mate with slots 52 of cross supports 50.

Coil supports 60 may comprise an electrically insulating property and a moderately high to high dielectric property of at least approximately 1480 volts-AC for at least approximately one minute. Coil supports 60 may be made from a heat resistant material, including materials comprising mica or a ceramic, for example, that is configured to minimize deflection of coil supports 60 and resistance element 72 of heater coil assembly 70 between cross supports 50. In one embodiment, coil supports 60 may be exposed to operating temperatures generated by resistance element 72 of approximately 1100° F. to at least approximately 1300° F. In another embodiment, coil supports 60 may be exposed to operating temperatures of at least approximately 1700° F. In other embodiments, coil supports 60 may be exposed to higher or lower operating temperatures depending on the application. Coil supports 60 may, in some instances, be exposed to relatively short durations of temperatures up to approximately 2100° F.

In the embodiment of FIG. 1, coil supports 60 include apertures 62 for receiving male members 54 of cross supports 50. Male members 54 and apertures 62 may be configured to snap together. Heater coil assembly 70 of heating element assembly 12 comprises coil support 60 and resistance element 72, which may be helically wound around coil support 60 along the length of coil support 60. In this way, coil support 60 may support each loop or turn 74 of resistance element 72 along the length of each coil support 60. In the embodiment of FIG. 1, a pair of heater coil assemblies 70 is electrically connected together by a single length of resistance element 72. In other embodiments, a greater number of heater coil assemblies 70 may be electrically connected together by a single length of resistance element 72.

By supporting each loop or turn 74 of resistance element 72 by coil support 60, coil support 60 may replace discretely positioned ceramic insulators for supporting resistance element 72 while providing more uniform support of resistance element 72 over the length of the coil of resistance element 72 associated with each pass. And because each coil or pass of resistance element 72 is better supported along the axial length of coil support 60, resistance element 72 may be fabricated to comprise low-nickel and/or no-nickel compositions, for example, which may otherwise problematically deflect during or post operation if strung between conventional ceramic insulators positioned at discrete locations, thereby reducing unit costs of heating element assembly 12 and ultimately electric heater assembly 10. In one embodiment, resistance element 72 comprises approximately 60% nickel. In another embodiment, resistance element 72 comprises approximately 42% nickel. In another embodiment, resistance element 72 comprises approximately 40% nickel. In yet another embodiment, resistance element 72 comprises approximately 0% nickel. Nikrothal® 40 having published properties of 34% to 37% nickel, and Kanthal® AF having published properties of 0% nickel, are examples of resistance materials available from Sandvik Heating Technology at www.kanthal.com that are suitable for resistance element 72 for use in electric heater assembly 10.

The size and number of turns 74 on each heater coil assembly 70 is determined, at least in part, by the amount of heat that is needed to be generated. For example, as shown in the embodiment of FIG. 1, each heater coil assembly 70 of heating element assembly 12 comprises approximately 75 turns 74. Each heater coil assembly 70 may comprise a smaller or larger number of turns 74 than 75, and each heater coil assembly 70 may comprise a smaller or larger number of turns 74 as compared to an adjacent heater coil assembly 70. Coil support 60 is configured to be positioned along the central axis of turns 74 of heater coil assembly 70. In addition, each coil support 60 is sized to substantially approximate the inner diameter of each heater coil assembly 70. In the embodiment of FIG. 1 where heater coil assembly 70 is shown as comprising elliptical turns of resistance element 72, coil support 60 is configured to be positioned along the major axis defined by turns 74 of heater coil assembly 70. Coil supports 60 may comprise smooth peripheral edges, as shown in the embodiment of FIG. 1. In other embodiments, peripheral edges of coil supports 60 may comprise serrations, notches, or slots for receiving the turns of resistance element 72 to more easily maintain a fixed axial spacing or relationship between respective adjacent turns of resistance element 72. These features may be useful in electric heater designs that require relatively small distances between each respective turn of resistance element 72. Coil supports 60 may be inserted into a pre-formed coil of resistance element 72, or resistance element 72 may be wrapped around coil supports 60. In other embodiments, coil supports 60 may comprise a panel formed in the shape of a helix to support turns 74 comprising elliptical or circular shapes, for example. If turns 74 comprise elliptical shapes, each turn 74 would be positioned slightly out of phase of an adjacent turn 74 using a helical coil support 60. In this way, heat transfer to the working fluid may be improved because more surfaces of resistance element 72 may be exposed to the flow stream caused by the staggered rotational relationship of adjacent turns 74.

Upon fabricating one or more heating element assemblies 12 comprising any number of heater coil assemblies 70, heating element assemblies 12 may be installed upon respective cross supports 50. Each heating element assembly 12 is assembled onto cross supports 50 by inserting coil supports 60 edgewise into slots 52 and snapping coil supports 60 into place by engaging respective male members 54 with apertures 62 so as to lock coil supports 60 together with cross supports 50. As shown in FIG. 1, male members 54 in adjacent cross supports 50 oppose each other (i.e., point in opposite directions) to create a flexing action as the respective coil support 60 is inserted in slots 52. As male members 54 fully nest with apertures 62, coil supports 60 may return to their original, generally flat shape. Connecting coil supports 60 with cross supports 50 in this way helps to ensure coil supports 60 do not work loose during repeated thermal cycles or fall out of electric heater assembly 10. Slots 52 provide additional utility in that the angle of coil supports 60 can be modified to compliment different air flows. For example, coil supports 60 can be angled in such a way as to direct the air flow toward the center of electric heater assembly 10 or angled outward to spread the air flow.

Figure 2:
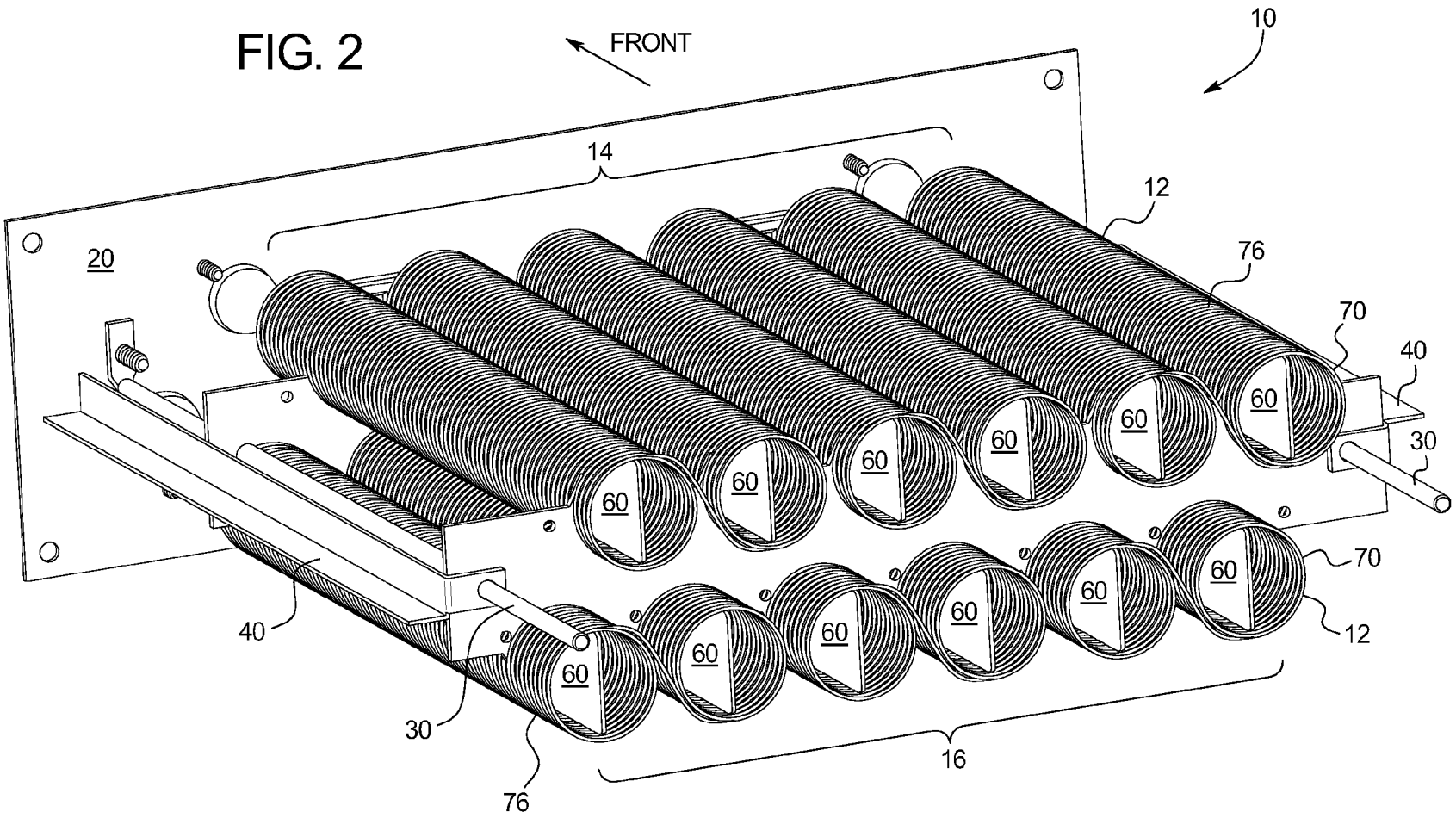
FIG. 2 is a perspective view showing another embodiment of an electric heater apparatus.

By supporting heater coil assemblies 70 along their axial length, resistance element 72 may comprise a geometry other than primarily a plurality of circular turns. For example, as shown in FIG. 1, resistance element 72 may be formed into the shape of an ellipse, as viewed from an end of heater coil assembly 70, with each elliptical turn 74 of heater coil assembly 70 being supported at respective vertices of each turn 74. As shown in the embodiment of FIG. 2, resistance element 72 may be formed into the shape of a circle and supported on inner surfaces of each turn 74. It should be noted that although coil supports 60 is configured to potentially support each turn 74 in heater coil assembly 70 of heating element assembly 12, an occasional turn 74 or minor number of turns 74 need not be actually supported at one or both vertices or inner surfaces by coil support 60, as may occur from differences in manufacturing tolerances or from minor, local relaxation of resistance element 72 as may occur from creep or from imperfect restoration of shape of turns 74 following respective heating and cooling cycles.

Figure 3:
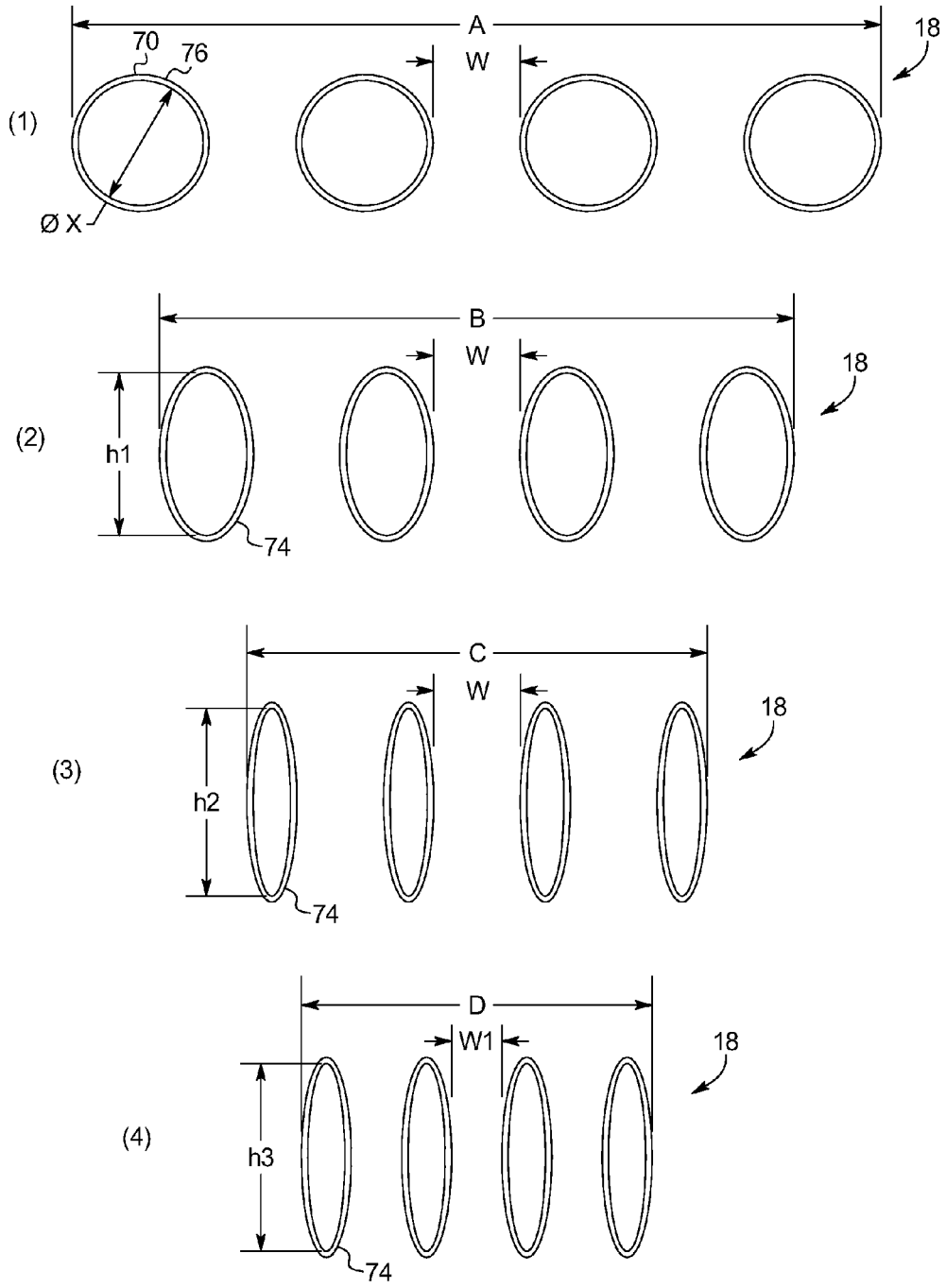
FIG. 3 is a schematic view showing relative sizes and placement of adjacent heating coils of a heating element assembly in accordance with the disclosure herein.

Turning to FIG. 3, an elliptical profile for turns 74 of resistance element 72 of heater coil assemblies 70 may provide for a narrower overall width of electric heater assembly 10 to conform electric heater assembly 10 to relatively smaller physical envelopes for residential or commercial HVAC air handlers without sacrificing heat output of electric heater assembly 10. One of ordinary skill would appreciate that other turn geometries, including circular, rectangular, squares, triangles, stars, and diamonds, for example, for resistance element 72 of heater coil assembly 70 may be used in combination with coil support 60 to support turns 74 of heater coil assembly 70. One of ordinary skill would further appreciate that more than one coil support 60 may be positioned inside respective heater coil assemblies 70 to support turns 74 if turns 74 require additional support, as may be the case with rectangular turn geometries, for example.

By using elliptical geometries for turns 74 of resistance element 72 of heater coil assembly 70, as opposed to using circular turn geometries, the same length of resistance element 72 can be placed in a smaller space without changing the axial length of respective heater coil assemblies 70 of heating element assembly 12. As shown in FIG. 3 row (1) of an exemplary 4-pass schematic of heating element assembly 18 for use in electric heater assembly 10, circular turns 76 having an inside diameter "X" of approximately 0.625" may comprise a center-to-center "electrical" spacing of approximately 1.125" as measured from the center axis of one coil to the center axis of an adjacent coil, an edge-to-edge width "W" of approximately 0.432" between adjacent rows of heater coil assemblies 70, and an overall outside width "A" of approximately 4.1" from end to end of respective outer edges of heating element assembly 18 for a 4-pass array. While maintaining spacing "W" and without changing the axial length of heater coil assemblies 70, as shown in the examples of FIG. 3 rows (2) and (3), the overall widths "B" and "C" can be reduced to, for example, approximately 3.188" and 2.311", respectively, corresponding to elliptically-profiled turns 74 having height "h1" equal to approximately 0.812" and height "h2" equal to approximately 0.941", respectively.

Flattening an otherwise circular turn 76 by approximately ⅓ of its original diameter (i.e., row (2)) to form elliptical turn 74 produces an approximately 22% reduction in the width of heating element assembly 18, as shown at "B". Flattening circular turn 76 by approximately ⅔ of its original diameter (i.e., row (3)) produces an approximately 43% reduction in the width of heating element assembly 18, as shown at "C". More wattage, as may occur by increasing the number of heater coil assemblies 70, all other variables being the same, such as length, gauge, and material composition of resistance element 72, can therefore be positioned in an equivalent space. Alternatively, the same number of heater coil assemblies 70 may be positioned in a smaller space. As noted above, the height "h1" and "h2" of each heater coil assembly 70 modestly increases when reducing the width or diameter "X" of circular turn 76, but this added height does not adversely affect envelope constraints or performance of electric heater assembly 10.

In certain embodiments comprising coil supports 60, the electrical spacing "W" can safely be reduced to create an even more compact electric heater assembly 10. For example, as shown in row (4) of FIG. 3, heater coil assembly 70 is represented as having width "w1" smaller than width "W" of rows (1) through (3). In one embodiment, width "w1" is approximately equal to 0.250". If the same geometry of elliptical turn 74 of row (3) of FIG. 3 is used in combination with "w1", overall width "D" can be reduce to approximately 1.764", which represents an approximately 57% reduction in width of heating element assembly 18 as compared to width "A" of row (1) of FIG. 3 in which circular turns 76 are utilized. As such, substantial flexibility is provided by incorporating to add an even greater number of heater coil assemblies 70 in a given envelope, or reduce the envelope occupied by electric heater assembly 10. In addition, smaller gauge thickness for resistance element 72 may be used without negatively impacting performance or life of the system.

One of ordinary skill would appreciate that the foregoing description for electric heater assembly 10 provides manufacturing advantages in that welding of adjoining parts may not necessarily be required to assemble the various components of electric heater assembly 10. In addition, the cost of resistance element 72 may be reduced to provide the same heat output as a conventional heater assembly incorporating a single circuit because either or both of the gauge of wire can be reduced and the composition of nickel can be reduced or eliminated as a result of the continuous support to the loops of the coiled resistance wire provided by coil support 60. And by providing continuous support to resistance element 72, additional options become available to minimize the physical envelope of the electric heater, such as the reduction in width created by elliptical loops or turns of resistance element 72 in each heater coil assembly 70.

Figure 4:
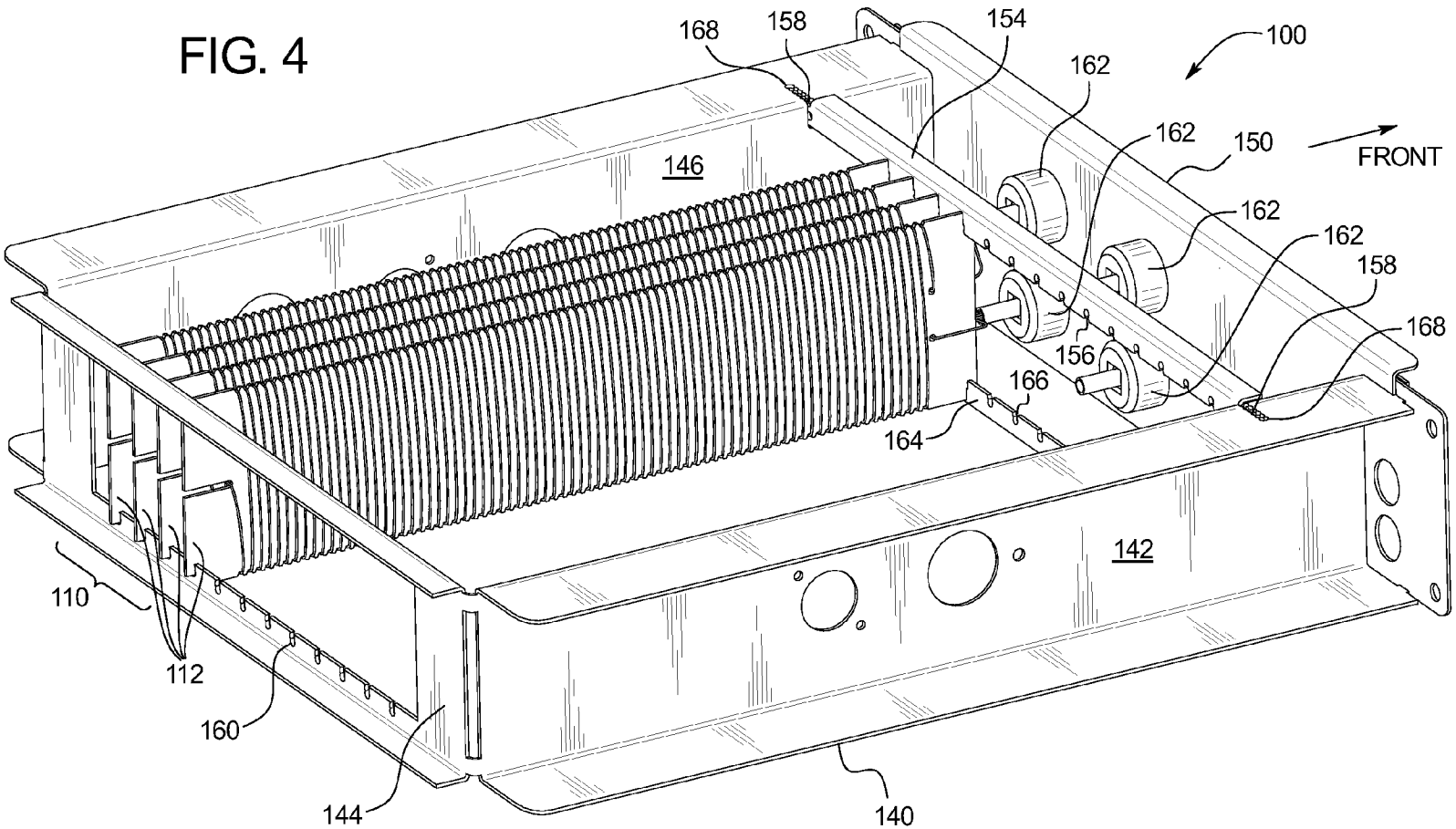
FIG. 4 is a partial perspective view of another embodiment of an electric heater apparatus.

Turning now to the embodiment of FIG. 4, there is shown an exemplary quad coil 12-heater coil (eight heater coil assemblies are not shown for clarity) electric heater assembly 100. Electric heater assembly 100 may be installed in a residential or commercial HVAC air handler either horizontally, vertically, or at an angle depending on the direction of flow of the working fluid. As discussed more fully below, a quad coil design, where a module comprising four heater coil assemblies are electrically connected in parallel to one another and where multiple modules are electrically connected together to provide a target heat output, allows a further reduction in mass of resistance element 72 to obtain the same heat output as compared to a conventional electric heater that does not incorporate a longitudinally continuous coil support such as coil support 60. Whereas the dual coil 12-pass electric heater assembly 10 discussed above may provide an approximately 40% reduction in the mass of resistance element 72 when using, for example, 20 gauge resistance wire, the quad coil design described below may provide an approximately 60% reduction in the mass of resistance element 72 as compared to a conventional electric heater by using, for example, 24 gauge resistance wire.

In the embodiment of FIG. 4, electric heater assembly 100 comprises three-sided frame 140 connected to base plate 150, upper cross support 154, lower cross support 164, and four quad coil heating element assemblies 110 (three quad coil heating element assemblies 110 are not shown for clarity). Each of the quad coil heating element assemblies 110 includes four heater coil assemblies 112 electrically connected together by resistance element 114. In other embodiments, a fewer or greater number of quad coil heating element assemblies 110 may be used to achieve a desired heat output. In addition, a fewer or greater number of heater coil assemblies 112 may be utilized to obtain a desired heat output.

Base plate 150 may comprise a panel made of, for example, a metal of suitable thickness and other properties from which to mount and support the other elements of electric heater assembly 100. Base plate 150 may also include a plurality of electrical terminals 162 for connection to respective quad coil heating element assemblies 110 by terminal posts 174.

Frame 140 comprises left panel 142, rear panel 144, and right panel 146. Left panel 142, rear panel 144, and right panel 146 may be separate panels joined together, or as shown in FIG. 4, may be formed from a single panel bent into a U-shape with left panel 142 and right panel 146 opposite and approximately parallel one another. Left panel 142, rear panel 144, and right panel 146 may be made of, for example, a metal of suitable thickness and other properties from which to mount and support upper cross support 154, lower cross support 164, and the quad-coil heating element assemblies 110.

Upper cross support 154 and lower cross support 164 may each comprise a U-shaped or an L-shaped bracket spanning the distance between left panel 142 and right panel 146. Upper cross support 154 may include extensions 158 configured to be received by slots 168 in left panel 142 and right panel 146 to removably retain quad-coil heating element assemblies 110 or individual heater coil assemblies 112 in frame 140. Upper cross support 154 and lower cross support 164 may each be made of, for example, a metal of suitable thickness and other properties upon which to mount coil supports 118. Upper cross support 154 and lower cross support 164 may alternatively be made from any material of suitable strength, durability, and resistance to heat.

Rear panel 144 may include upper slots (not shown) and lower slots 160 configured to receive an end of each coil support 118. Upper cross support 154 and lower cross support 164 may include slots 156 and slots 166, respectively, which are configured to receive an opposite end of each coil support 118. The position and alignment of slots 160,156,166 together with upper slots (not shown) in rear panel 144 relative to one another determine the position and angular orientation of cross supports 118 relative to oncoming airflow from an air handler.

Figure 5:
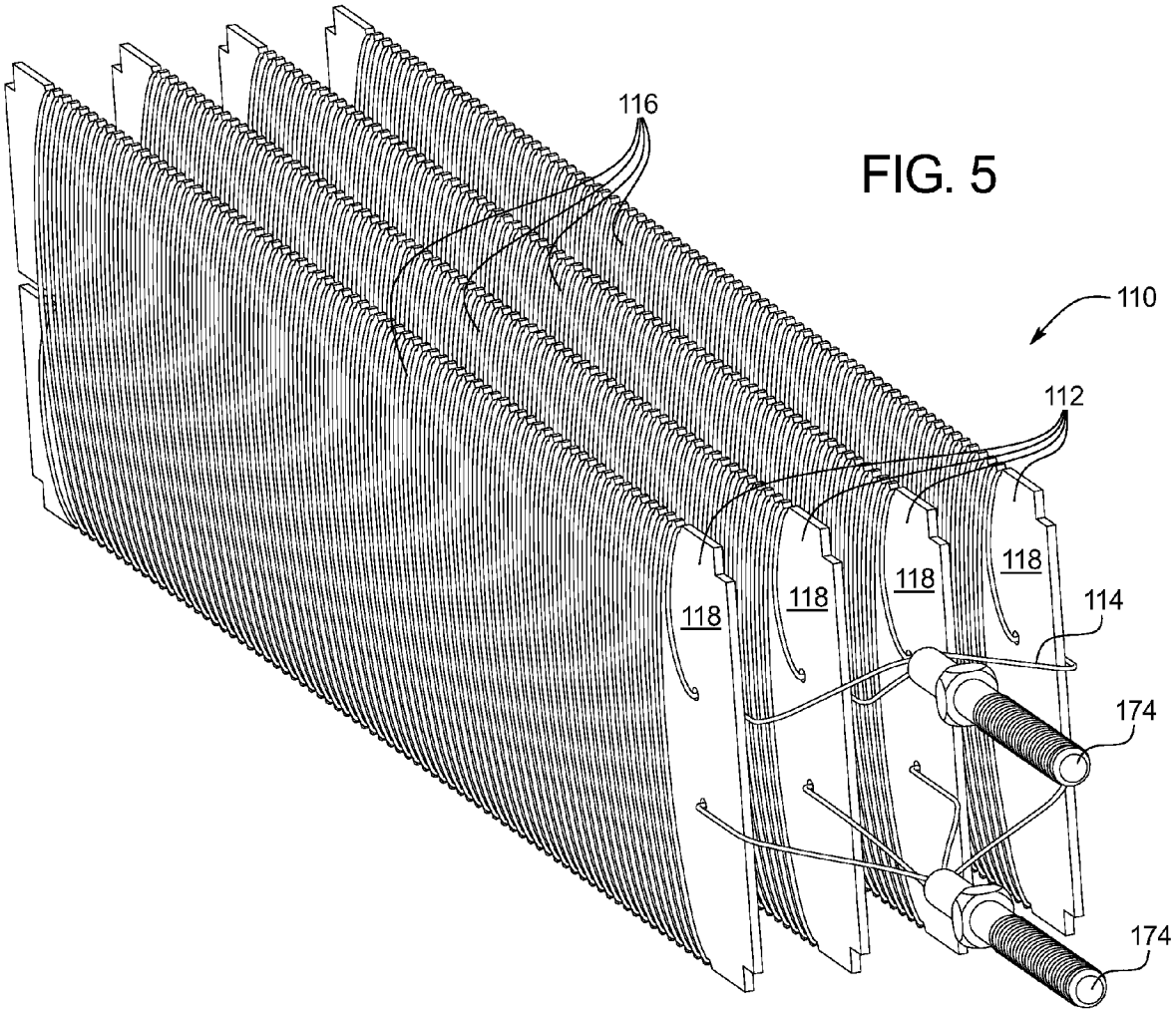
FIG. 5 is a perspective view of a heating element assembly shown in FIG. 4.

FIG. 5 shows and exemplary quad coil heating element assembly 110 of electric heater assembly 100 in greater detail. Quad coil heating element assembly 110 includes four heater coil assemblies 112 wired in parallel to one another. Quad coil heating element assembly 110 also includes a pair of terminal posts 174 for connection to terminals 162 in base plate 150. Quad coil heating element assembly 110 is configured to be manufactured and inventoried as a self-contained module for easy plug-in insertion into frame 140 to provide a preconfigured heat output per module. Multiple quad coil heating element assembly 110 modules can be inserted into frame 140 to obtain a desired heat output for electric heater assembly 100. Base plate 150 may incorporate electrical connections between terminals 162 to electrically connect adjacent modules to one another to obtain the desired heat output. Multiple quad coil heating assembly 110 modules may alternatively be hard-wired to one another.

Figure 6:
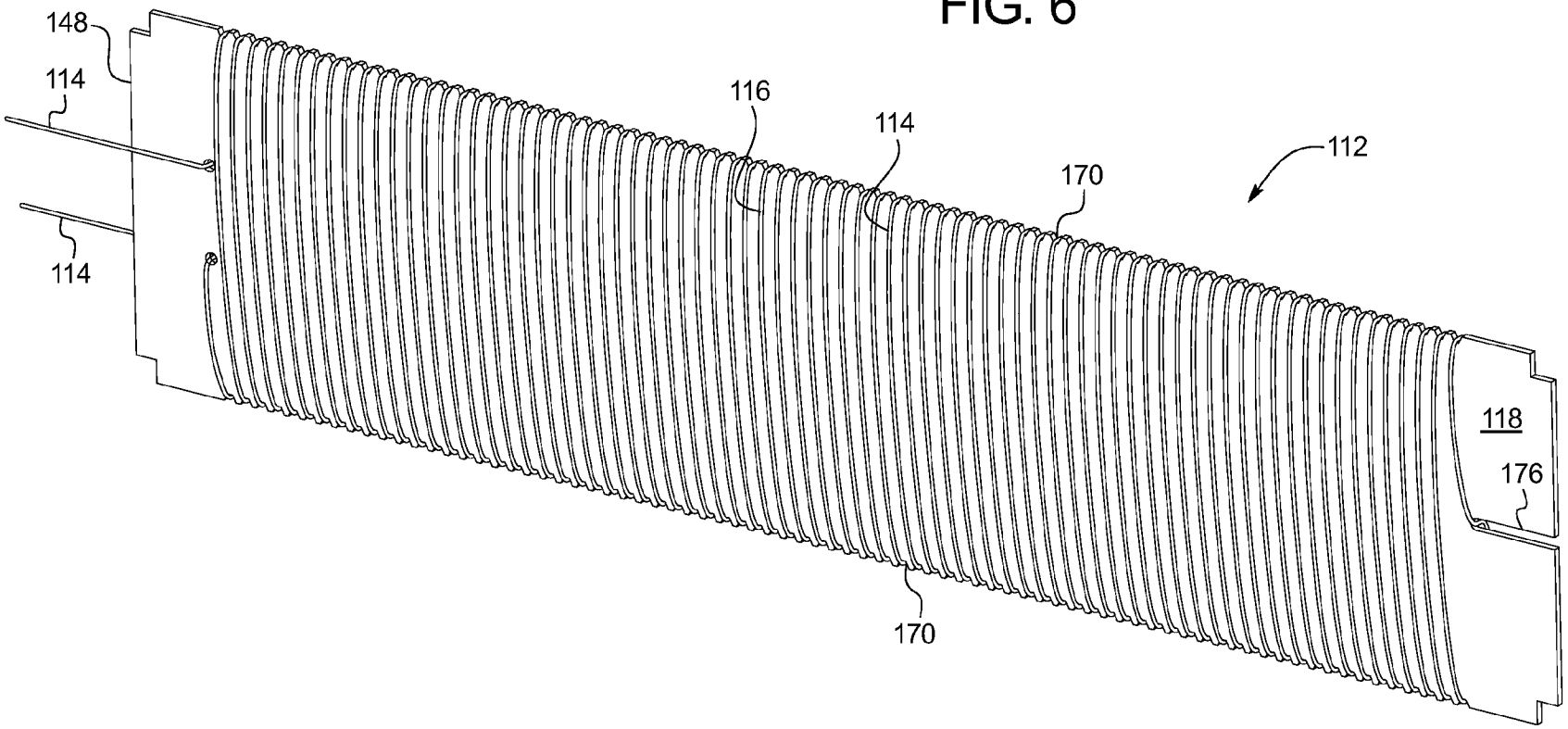
FIG. 6 is a partial perspective view of a heater coil assembly shown in FIG. 5.

FIG. 6 shows an exemplary heater coil assembly 112 of quad coil heating element assembly 110 in greater detail. Heater coil assembly 112 comprises coil support 118 and a length of electrical resistance element 114 of a suitable gauge helically wound around coil support 118 along the length of each coil support 118. Coil support 118 is configured to support each turn 116 of resistance element 114 along the length of each coil support 118, though an occasional turn 116 or a minor number of turns 116 need not be actually supported at one or both of two locations per loop due to differences in manufacturing tolerances or from minor, local relaxation of resistance element 114 as may occur from use.

The size and number of turns 116 on each heater coil assembly 112 is determined, at least in part, by the amount of heat that is needed to be generated. For example, as best shown in FIG. 6, each heater coil assembly 112 of quad coil heating element assembly 110 comprises approximately 78 turns 116. Each heater coil assembly 112 may comprise a smaller or larger number of turns 116 than 78, and each heater coil assembly 112 may comprise a smaller or larger number of turns 116 as compared to an adjacent heater coil assembly 112.

As shown in FIG. 6, each turn 116 of resistance element 114 wound around coil support 118 may have an elliptical profile, but other shapes, including circular, may be used. The centerline axis of each loop or turn 116 is approximately coaxial with a longitudinal centerline axis of heater coil assembly 110. An elliptical profile for turns 116 provides a compact width for electric heater assembly 100 as compared to other turn profiles of a coiled resistance element, such as would be provided by a circular profile.

Coil support 118 is configured to be positioned along the central axis of turns 116 of heater coil assembly 112. In addition, each coil support 118 is sized to substantially approximate the inner diameter of each heater coil assembly 112. In the embodiment of FIG. 6 where heater coil assembly 112 is shown as comprising elliptical turns of resistance element 114, coil support 118 is configured to be positioned along the major axis defined by turns 116 of heater coil assembly 112.

Coil support 118 may comprise smooth peripheral edges. In other embodiments, such as shown in FIGS. 5-6, peripheral edges of coil support 118 may comprise serrations, notches, or slots 170 for receiving turns 116 of resistance element 114 to more easily maintain a fixed axial spacing or relationship between respective adjacent turns of resistance element 114. These features may be useful in electric heater designs that require relatively small distances between each respective turn of resistance element 114. Coil supports 118 may be inserted into a pre-formed coil of resistance element 114, or resistance element 114 may be wrapped around coil supports 118.

Coil support 118 and resistance element 114 may have all of the same properties and characteristics as discussed above for coil support 60 and resistance element 72. Resistance element 114 may comprise, for example, resistance wire, which may be any size or gauge suitable for generating a desired amount of heat to the working fluid. In some embodiments of electric heater assembly 100, resistance element 114 comprises resistance ribbon. In the embodiment of FIGS. 4-7, resistance element 114 may comprise resistance wire comprising a smaller gauge, such as 24 gauge, which is significantly smaller in size than a conventional electric heater assembly having 16 gauge resistance wire, or the 20 gauge resistance wire usable in connection with the exemplary dual coil 12-pass electric heater assembly 10 described above. In addition, the smaller 24 gauge resistance wire reduces weight of the resistance wire and therefore cost, and is easier to manipulate into elliptical turns due to its less rigid characteristics. For example, to form elliptical turns using 24 gauge resistance wire, resistance element 114 is flexible enough to simply wind around coil support 118, which naturally results in the formation of the desired elliptical shape of turns 116. By contrast, given that 16 gauge resistance wire is more rigid than 20 gauge resistance wire and 20 gauge resistance wire is more rigid than 24 gauge resistance wire, an additional manufacturing step to obtain the desired shape may be required when using 16 or 20 gauge resistance wire, such as flattening the wound coil between two plates under pressure.

Figure 7:
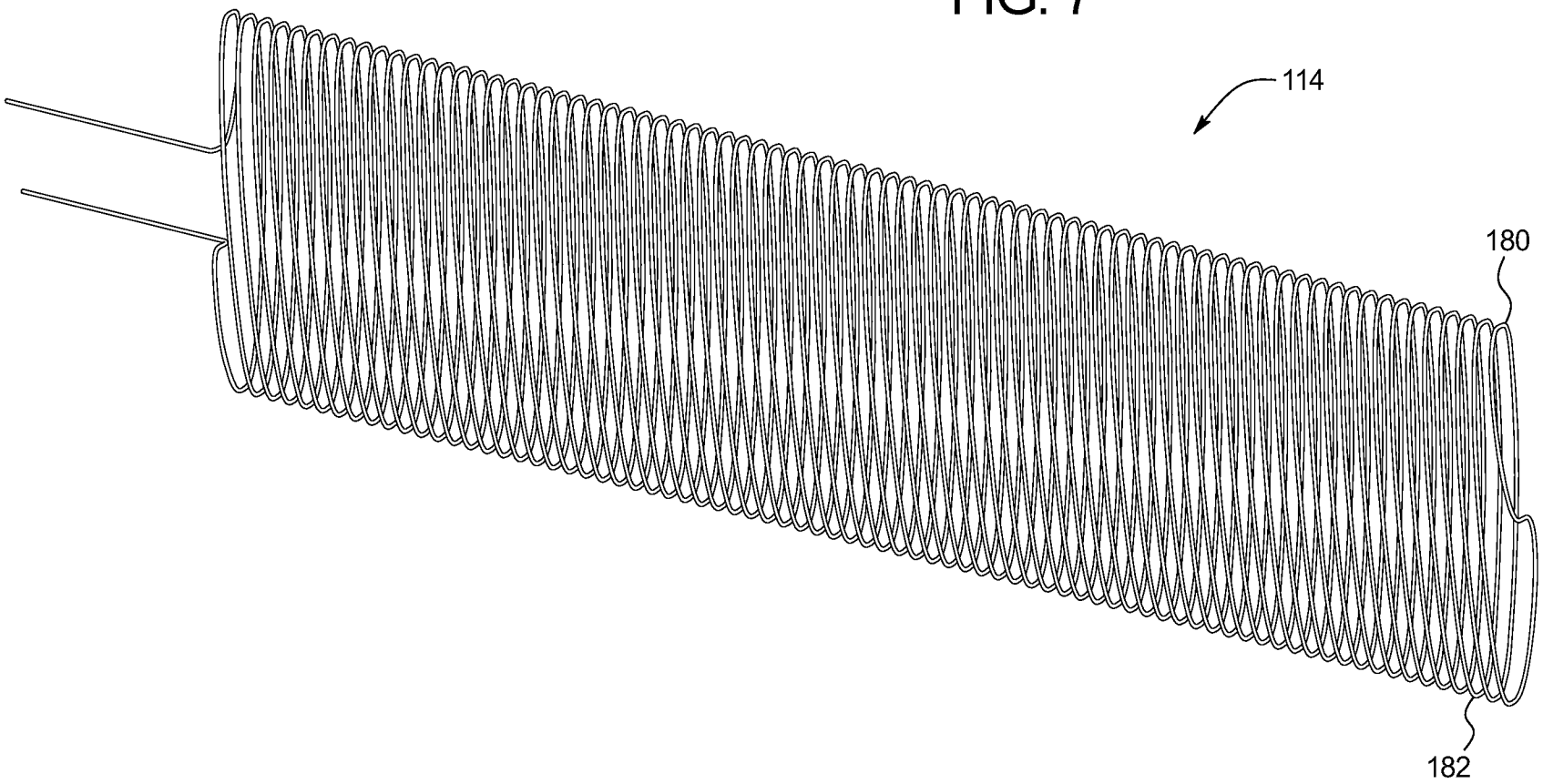
FIG. 7 is a partial perspective view of a portion of the heater coil assembly shown in FIG. 6.

To promote modularity and simplify assembly of heater coil assemblies 112 and to minimize usage of resistance element 114, as shown in FIG. 6, resistance element 114 may begin and end at the same end 148 of coil support 118. Starting at one end of coil support 118, resistance element 114 may be looped around coil support 118 to form a resistance coil from one end of coil support 118 to the other end, leaving a space between each forward loop 180 for respective return loops 182. At the opposite end of coil support 118, resistance element 114 is passed through slot 176, then looped around coil support 118 so that return loops 182 lie between respective forward loops 180. FIG. 7 shows forward loops 180 and return loops 182 with coil support 118 omitted for clarity.

Figure 8:
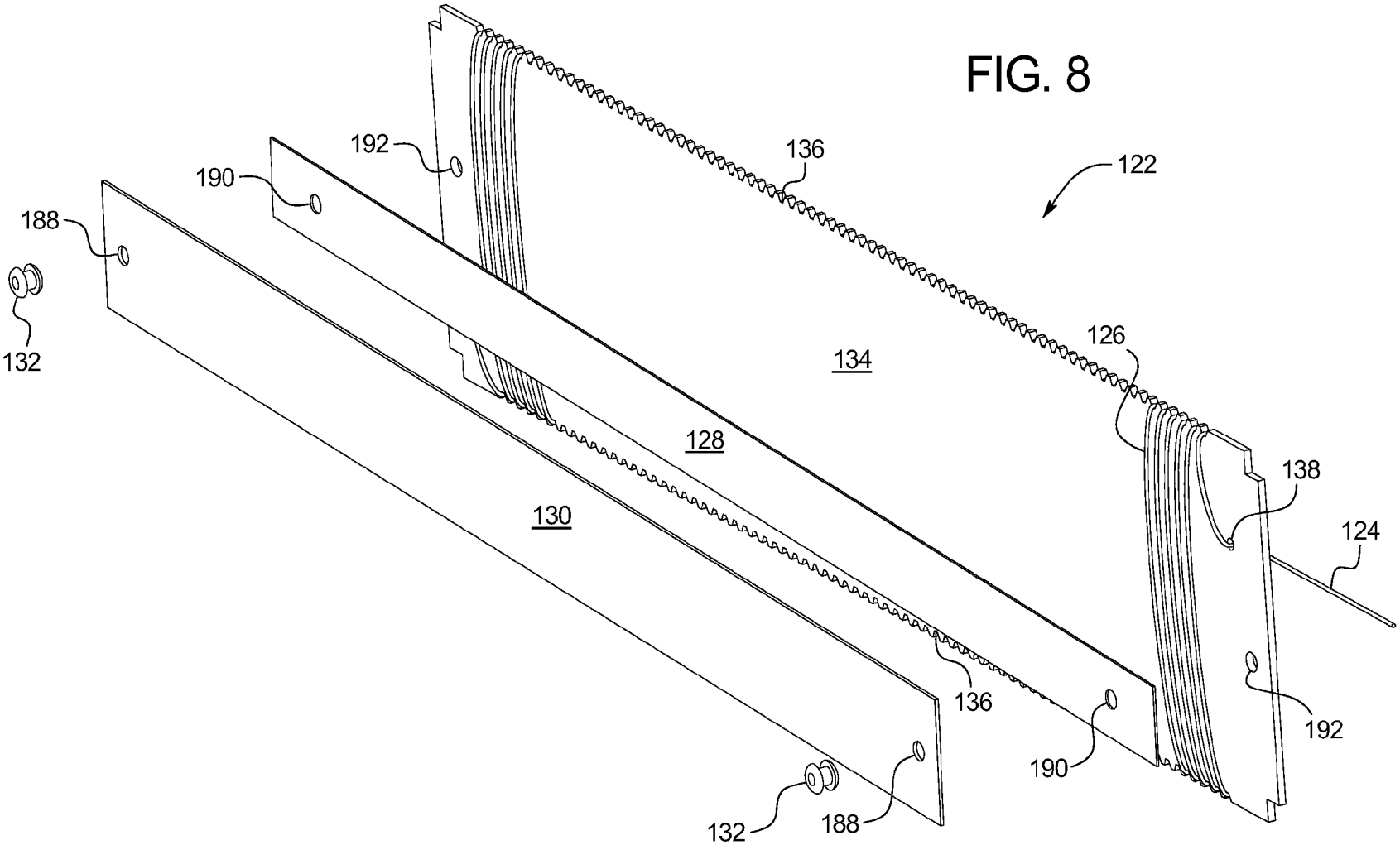
FIG. 8 is an exploded, partial perspective view of another embodiment of a heater coil assembly.
Figure 9:
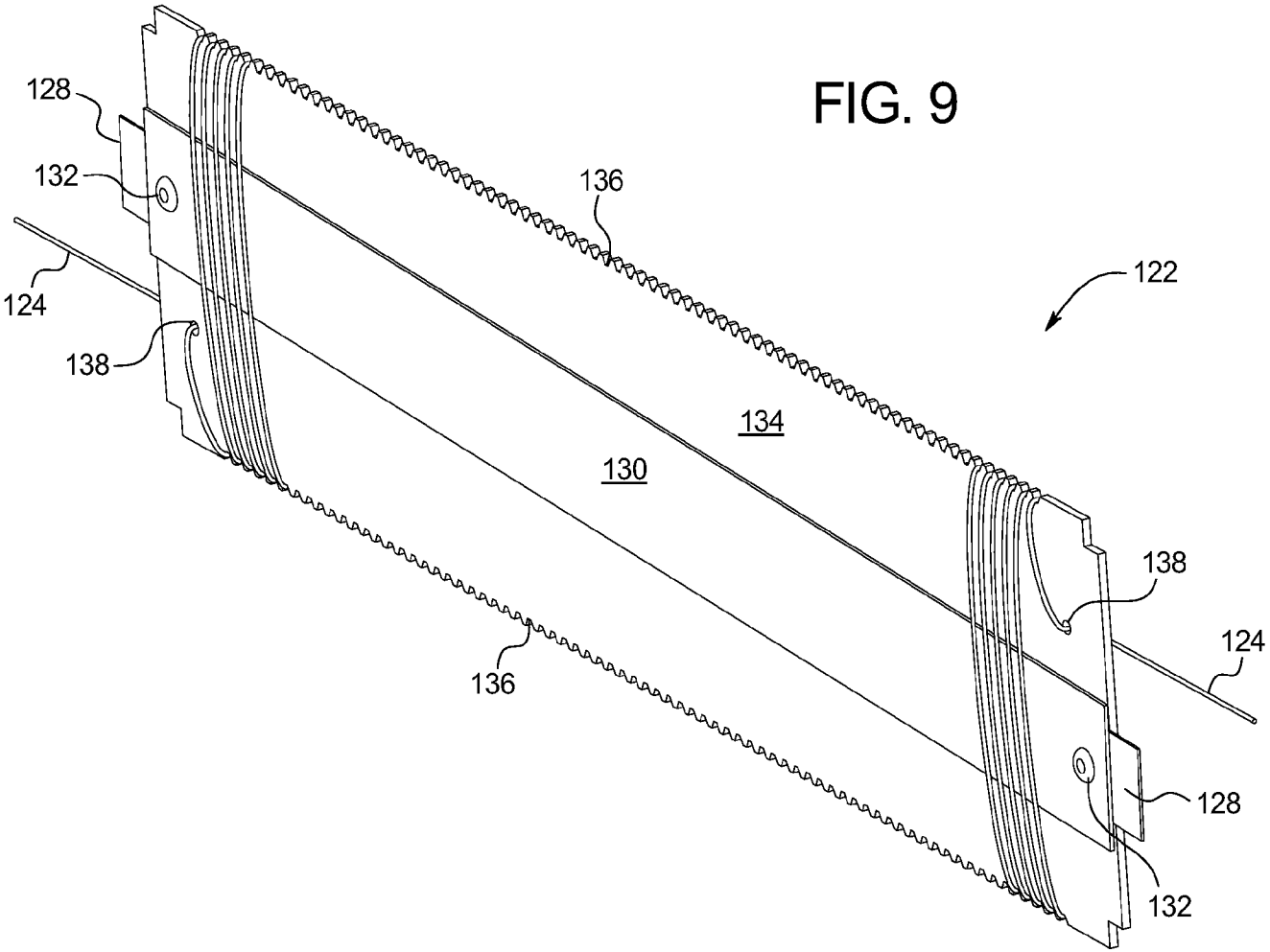
FIG. 9 is a perspective view of the heater coil assembly shown in FIG. 8.

An alternative embodiment of a heater coil assembly is shown in FIGS. 8-9. Heater coil assembly 122 comprises coil support 134, a length of electrical resistance element 124 of a suitable gauge helically wound around coil support 134 along the length of coil support 134, jumper 128, jumper mount 130, and fastener 132.

As described above for coil support 60,118, coil support 134 is configured to support each turn 126 of resistance element 124 from one end of coil support 134 to the other, opposite end, though an occasional turn 126 or a minor number of turns 126 need not be actually supported at one or both of two locations per loop due to differences in manufacturing tolerances or from minor, local relaxation of resistance element 124 as may occur from use. In the embodiment shown in FIGS. 8-9, peripheral edges of coil support 134 include serrations, notches, or slots 170 for receiving turns 126 of resistance element 124 to more easily maintain a fixed axial spacing or relationship between respective adjacent turns of resistance element 124. In other embodiments, coil support 134 may comprise smooth peripheral edges. Coil support 134 may be inserted into a pre-formed coil of resistance element 124, or resistance element 124 may be wrapped around coil support 134.

Jumper 128 is configured to return electrical continuity from one end to the other end of heater coil assembly 122. Jumper 128 may be made of any electrically conductive material, and although is shown in FIGS. 8-9 as a flat panel, may alternatively be configured in any geometry or manner that provides electrical connectivity from one end of coil support 134 to the opposite end of coil support 134. Jumper 128 is positioned adjacent coil support 134 and extends past a first end and a second, opposite end of coil support 134.

Jumper mount 130 is configured to electrically insulate jumper 128 from resistance element 124. Jumper mount 130 is also configured to cover jumper 128 when installed. To secure jumper 128 to coil support 134, jumper mount 130 is positioned over jumper 128 and secured to coil support using fasteners 132 positioned in apertures 188,190,192 in jumper 128, jumper mount 130, and coil support 134, respectively.

Resistance element 124 is wound over jumper mount 130 and jumper 128. Starting at the first end of coil support 134, resistance element 124 is passed through aperture 138 to anchor resistance element 124. Resistance element 124 is then wound around coil support 134 and positioned in sequential serrations, notches, or slots 136 positioned on respective upper and lower edges of coil support 134. In other embodiments, upper and lower edges of coil support 134 may be smooth. At a second, opposite end of coil support 134, resistance element 124 is passed through aperture 138 to anchor resistance element 124. As illustrated in FIG. 9, resistance element 124 of heater coil assembly 122 starts at one end and exits the other end of heater coil assembly 122. But because jumper 128 provides an electrical bridge from the first end to the second end of coil support 134, heater coil assembly 122 may be installed in a frame in either direction, thus providing simpler electric heater assembly and simpler inventorying of a symmetrical heater coil assembly 122.

While specific embodiments have been described in detail, it will be appreciated by those skilled in the art that various modifications and alternatives to those details could be developed in light of the overall teachings of the disclosure. In particular, the coil supports and elliptically-formed turns of the heater coil assemblies described herein may be used in any number of different ways and in different applications not necessarily involving residential or commercial HVAC systems. Accordingly, the disclosure herein is meant to be illustrative only and not limiting as to its scope and should be given the full breadth of the appended claims and any equivalents thereof.

What is claimed is:

1. An electric heater apparatus for heating air, comprising:

a heater coil assembly including a coil support comprising a panel around which lies a coil of an electrical resistance element from approximately one end of the panel to approximately an opposite end, the coil of the electrical resistance element comprising a pass of spaced apart, elliptically-shaped, non-zigzagged loops helically positioned around the panel, the coil support configured to support the spaced apart loops.

2. The apparatus of claim 1, wherein a portion of the pass of spaced apart loops extend past a longitudinal edge of the coil support.

3. The apparatus of claim 1, wherein the coil support lies along a longitudinal axis of the coil of the electrical resistance element.

4. The apparatus of claim 1, wherein the coil support comprises mica.

5. The apparatus of claim 1, wherein the coil support comprises a heat resistant material.

6. The apparatus of claim 5, wherein the heat resistant material is operable to withstand an operating temperature of at least approximately 1700° F.

7. The apparatus of claim 1, wherein the coil support comprises a high dielectric constant.

8. The apparatus of claim 1, comprising a pair of heater coil assemblies arranged side-by-side, wherein a single length of the electrical resistance element forms the coils associated with the pair of heater coil assemblies.

9. The apparatus of claim 8, comprising a first plurality of pairs of heater coil assemblies and a second plurality of pairs of heater coil assemblies arranged offset and in staggered relation to the first plurality of pairs of heater coil assemblies.

10. The apparatus of claim 1, wherein the electrical resistance element comprises resistance wire.

11. The apparatus of claim 1, wherein the electrical resistance element comprises approximately 16 gauge or smaller resistance wire.

12. The apparatus of claim 1, wherein the electrical resistance element comprises a low-nickel composition.

13. The apparatus of claim 12, wherein the low-nickel composition comprises approximately 40% nickel.

14. The apparatus of claim 1, wherein the electrical resistance element comprises a composition excluding nickel.

15. The apparatus of claim 1, wherein the electrical resistance element comprises a ribbon.

16. An electric heater apparatus for an air handler, comprising:

a base plate;

a plurality of frame supports extending from the base plate;

a plurality of cross supports connected to the frame supports; and at least one heating element assembly connected to the cross supports, the at least one heating element assembly comprising a coil of resistance wire comprising a plurality of spaced apart, non-zigzagged elliptical portions arranged with respective vertices of the elliptical portions substantially aligned with one another; and at least one coil support for supporting the coil of resistance wire, comprising a panel positioned inside the coil of resistance wire and at the respective vertices of the elliptical portions, the at least one coil support supporting the plurality of elliptical portions of the coil of resistance wire.

17. The apparatus of claim 16, wherein the at least one coil support comprises mica.

18. The apparatus of claim 16, comprising a first plurality of heating element assemblies and a second plurality of heating element assemblies arranged offset and in staggered relation to the first plurality of heating element assemblies.

19. The apparatus of claim 16, wherein the resistance wire comprises approximately 16 gauge or smaller.

20. The apparatus of claim 16, wherein the resistance wire comprises a low-nickel composition.

21. The apparatus of claim 20, wherein the low-nickel composition comprises approximately 40% nickel or less.

22. The apparatus of claim 16, wherein the resistance wire comprises a composition excluding nickel.

23. The apparatus of claim 16, wherein the at least one coil support is positioned at an oblique angle relative to a direction of airflow.

24. The apparatus of claim 16, wherein a side of the at least one coil support is engaged with a slot in the cross supports.

25. An electric heater apparatus for an air handler, comprising:

a base plate;

a plurality of frame supports extending from the base plate;

a plurality of cross supports connected to the frame supports for supporting the cross supports; and at least two heating element assemblies connected to the cross supports on opposite sides of the cross supports in staggered relation to one another, the cross supports supporting the at least two heating element assemblies, each of the at least two heating element assemblies comprising a plurality of spaced apart coils of resistance wire arranged side-by-side, at least one of the coils comprising a plurality of spaced apart, non-zigzagged elliptical portions arranged with respective vertices of the elliptical portions substantially aligned with one another, and at least one coil support comprising at least one panel positioned inside each of the spaced apart coils and supporting a majority of turns of each of the spaced apart coils at each of approximately two locations of each such turn approximately opposite one another.

26. The apparatus of claim 25, wherein a side of the at least one coil support is engaged with a slot in the cross supports.

27. The apparatus of claim 26, wherein the at least one coil support and the cross supports are captively yet releasably coupled to one another opposite the slot without fasteners.

28. The apparatus of claim 25, wherein the cross supports comprise a protrusion that engages an aperture in the at least one coil support, the cross supports and the at least one coil support being held together via a snap fit.

29. The apparatus of claim 25, wherein the at least one coil support comprises mica.

30. The apparatus of claim 25, wherein the resistance wire comprises a composition comprising approximately 40% nickel or less.

31. The apparatus of claim 25, wherein the resistance wire comprises a composition that excludes nickel.

32. The apparatus of claim 25, wherein adjacent spaced apart coils are electrically connected to one another in parallel by the resistance wire.

33. The apparatus of claim 16, wherein the at least one coil support is positioned parallel to a direction of airflow.

* * * * *